US007559375B2

(12) United States Patent
Dybevik et al.

(10) Patent No.: US 7,559,375 B2
(45) Date of Patent: Jul. 14, 2009

(54) FLOW CONTROL DEVICE FOR CHOKING INFLOWING FLUIDS IN A WELL

(76) Inventors: Arthur Dybevik, Harriet Backersgate 19, Sandnes (NO) N-4307; Ove Sigurd Christensen, Rollaugsgata 28, Hafrsfjord (NO) N-4141; Terje Moen, Diamantveien 36A, Sandnes (NO) N-4318

( * ) Notice: Subject to any disclaimer, the term of this patent is extended or adjusted under 35 U.S.C. 154(b) by 0 days.

(21) Appl. No.: 12/125,761

(22) Filed: May 22, 2008

(65) Prior Publication Data

US 2008/0217001 A1 Sep. 11, 2008

Related U.S. Application Data

(63) Continuation of application No. 10/472,727, filed as application No. PCT/NO02/00105 on Mar. 15, 2002, now Pat. No. 7,419,002.

(30) Foreign Application Priority Data

Mar. 20, 2001 (NO) ..... 20011420

(51) Int. Cl.
*E21B 43/12* (2006.01)

(52) U.S. Cl. ..... 166/316; 166/227

(58) Field of Classification Search ..... 166/227, 166/316, 386, 169, 205, 373
See application file for complete search history.

(56) References Cited

U.S. PATENT DOCUMENTS

| | | | | |
|---|---|---|---|---|
| 4,640,355 A | | 2/1987 | Hong et al. | |
| 4,782,896 A | | 11/1988 | Witten | |
| 4,921,044 A | | 5/1990 | Cooksey | |
| 5,435,393 A | * | 7/1995 | Brekke et al. | 166/370 |
| 5,803,179 A | * | 9/1998 | Echols et al. | 166/370 |
| 6,112,817 A | * | 9/2000 | Voll et al. | 166/370 |

* cited by examiner

*Primary Examiner*—Jennifer H Gay
*Assistant Examiner*—Robert E Fuller
(74) *Attorney, Agent, or Firm*—James L. Kurka; Jeremy P. Welch; Andrus, Sceales, Starke & Sawall

(57) ABSTRACT

A flow arrangement (10, 12) for use in a well through one or more underground reservoirs, and where the arrangement (10, 12) is designed to throttle radially inflowing reservoir fluids produced through an inflow portion of the production tubing in the well, the production tubing in and along this inflow portion being provided with one or more arrangements (10, 12). Such an arrangement (10, 12) is designed to effect a relatively stable and predictable fluid pressure drop at any stable fluid flow rate in the course of the production period of the well, and where said fluid pressure drop will exhibit the smallest possible degree of susceptibility to influence by differences in the viscosity and/or any changes in the viscosity of the inflowing reservoir fluids during the production period. Such a fluid pressure drop is obtained by the arrangement (10, 12) comprising among other things one or more short, removable and replaceable flow restrictions such as nozzle inserts (44, 62), and where the individual flow restriction may be given the desired cross section of flow, through which reservoir fluids may flow and be throttled, or the flow restriction may be a sealing plug.

18 Claims, 7 Drawing Sheets

FLOW CONTROL DEVICE FOR CHOKING INFLOWING FLUIDS IN A WELL

CROSS-REFERENCE TO RELATED APPLICATIONS

The present application is a continuation of U.S. patent application Ser. No. 10/472,727, filed Feb. 5, 2004, now U.S. Pat. No. 7,419,002 which is incorporated herein by reference. U.S. patent application Ser. No. 10/472,727 is the U.S. national phase application of International Application No. PCT/NO 02/001 05, filed Mar. 15, 2002, which is incorporated herein by reference. The International Application claims priority of Norwegian Patent Application 20011420, filed Mar. 20, 2001, which is incorporated herein by reference.

AREA OF USE FOR THE INVENTION

The present invention concerns a flow control device for choking pressures in fluids flowing radially into a drainage pipe of a well, preferably a petroleum well, while producing said fluids from one or more underground reservoirs. Said drainage pipe hereinafter is termed production tubing.

Preferably, the flow control device is used in a horizontal or approximately horizontal well, hereinafter simply termed horizontal well. Such flow control devices are particularly advantageous when used in wells of long horizontal extent. The invention, however, may equally well be used in non-horizontal wells.

BACKGROUND OF THE INVENTION

The invention has been developed to prevent or reduce several problems occurring in a hydrocarbon reservoir and its horizontal well(s) when subjected to production-related changes in the reservoir fluids. Among many things, these production-related changes lead to fluctuating production rates and uneven drainage of the reservoir. More particularly, this invention seeks to remedy problems associated with production-related changes in the viscosity of the reservoir fluids.

At the upstream side of a horizontal well the production tubing is placed in the horizontal or near-horizontal section of the well, hereinafter simply termed horizontal section. During production the reservoir fluids flow radially in through orifices or perforations in the production tubing. The production tubing also may be provided with filters or so-called sand screens that prevent formation particles from flowing into the production tubing.

When the reservoir fluids flow through the horizontal section of the production tubing, the fluids are subjected to a pressure loss due to flow friction, and the frictional pressure loss normally is non-linear and is increasing strongly in the downstream direction. As a result, the pressure profile in the fluid flow in the production tubing well is non-linear and is decreasing strongly in the downstream direction.

At the onset of production, however, the fluid pressure of the surrounding reservoir rock often is relatively homogenous, and it changes insubstantially along the horizontal section of the well. Thus the differential pressure between the fluid pressure of the reservoir rock and the fluid pressure inside the production tubing is non-linear and is increasing strongly in the downstream direction. This causes the radial inflow rate per unit length of horizontal section of the production tubing to be substantially larger at the downstream side (the "heal") than that at the upstream side (the "toe") of the horizontal section. Downstream reservoir zones therefore are drained substantially faster than upstream reservoir zones, causing uneven drainage of the reservoir.

During the early to intermediate stages of hydrocarbon recovery, and especially in crude oil recovery, this situation may cause water and/or gas to flow into downstream positions of the horizontal section and to mix with the desired fluid. This effect is referred to as so-called water coning or gas coning in the well. This particularly applies to wells having extensive horizontal length, the length of which may be in the order of several thousand meters, and in which the frictional pressure loss of the fluids within the horizontal section is substantial. This situation causes technical disadvantages and problems to the production.

Uneven rate of fluid inflow from different zones of the reservoir also cause fluid pressure differences between the reservoir zones. This may result in so-called cross flow or transverse flow of the reservoir fluids, a condition in which the fluids flow within and along an annulus between the outside of the production tubing and the wellbore wall in stead of flowing through the production tubing.

Due to said recovery related situations and problems, flow control devices may be used to appropriately choke the partial flows of reservoir fluids flowing radially into the production tubing along its horizontal inflow portion, and in such a way that the reservoir fluids obtain equal, or nearly equal, radial inflow rate per unit length of the well's horizontal section.

Prior Art

European patent application EP 0.588.421, corresponding to U.S. Pat. No. 5,435,393, discloses flow control devices for choking the fluid pressure, hence the radial inflow rate, of reservoir fluids flowing into a production tubing. These flow control devices are designed to cause flow friction, hence a pressure loss, in reservoir fluids when they are flowing through such a flow control device. The flow friction and the accompanying pressure loss in the fluids occur within the device itself.

EP 0.588.421 describes a production tubing consisting of several pipe sections. Each such pipe section is provided with flow control devices consisting of at least one inflow channel through which reservoir fluids flow prior to entering the production tubing. In the inflow channels the fluids are subjected to the noted flow friction that gives rise to the accompanying pressure loss in the inflowing fluids. Such an inflow channel is placed in an opening or an annulus between the outside and the inside of the production tubing, for example in the form of a bulb or a sleeve provided to the production tubing. In one embodiment the reservoir fluids are guided through a sand screen and onwards through an inflow channel of said type before entering the production tubing of the well. According to EP 0.588.421 such inflow channels may consist of longitudinal thin pipes, bores or grooves, through which channels the fluids flow and experience said flow friction and associated fluid pressure loss. By providing each production pipe section with an appropriate number of thin pipes, bores or grooves having a suitable geometrical shape, the fluid pressure loss in each pipe section largely may be controlled. This geometrical shape includes, for example, a suitable cross sectional area and/or length of the inflow channel.

Disadvantages of the Prior Art

The flow control devices disclosed in EP 0.588.421 are encumbered with several application limitations when subjected to ambient conditions, for example pressure, temperature and fluid composition, existing at any time in a producing petroleum well, and these conditions change during the well's recovery period.

These flow control devices also may be complicated to manufacture and/or assemble in a pipe. For example, these devices require the use of extensive and costly machining equipment to these to be assembled in a production tubing.

Moreover, when the viscosities of the inflowing reservoir fluids vary much during the recovery period, these flow control devices are unsuited for providing a predictable fluid pressure loss in the inflowing reservoir fluids. As mentioned, the fluid pressure loss in the flow control devices of EP 0.588.421 is based on flow friction in an inflow channel. Among other things, this pressure loss is proportional to the fluid viscosity both at laminar and turbulent flow through the channel. Large fluctuations in the viscosities of the reservoir fluids therefore will influence this pressure loss significantly, hence significantly influencing the associated fluid inflow rate through such a flow control device. Therefore the production rate of the well largely becomes unpredictable and difficult to control.

Changes within a reservoir largely result from all naturally occurring reservoirs, and especially hydrocarbon reservoirs, being heterogeneous and displaying three-dimensional variations in their physical and/or chemical properties. This includes variations in porosity, permeability, reservoir pressure and fluid composition. Such reservoir properties and natural variations are subject to change during the recovery of the reservoir fluids.

During the hydrocarbon production, the properties of the inflowing reservoir fluids change gradually, including gradual changes in their fluid pressure and fluid composition. The recovered fluids therefore may consist of both liquid- and gas phases, including different liquid types, for example water and oil or mixtures thereof. Due to differences in the specific gravity of these fluids, the fluids normally are segregated in the hydrocarbon reservoir and may exist as an upper gas layer (a gas cap), an intermediate oil layer and a lower water layer (formation water). Further segregations based on specific gravity differences may also exist within the individual fluid phases, and particularly within the oil phase. Such conditions provide for large viscosity variations taking place in the produced fluids.

Petroleum production also provide for displacement of the boundaries, or contacts, between the fluid layers within the reservoir. When large capillary effects prevail in the reservoir pores, the fluid layer boundaries also may exist as transition zones within the reservoir. These transition zones also will displace within the reservoir during the recovery operation. Within such a transition zone a mixture of fluids from each side of the zone exist, for example a mixture of oil and water. Upon displacing the transition zone within the reservoir, the internal quantity distribution of the fluid constituents, for example the oil/water-ratio, will change in those reservoir positions affected by these fluid migrations. Displacement of fluid layer boundaries or fluid boundary transition zones within the reservoir may provide for large viscosity variations in the produced fluids.

Even though the viscosities of the reservoir fluids may vary within a wide range of values during the recovery period, the specific gravity of the same reservoir fluids normally will vary insignificantly during the recovery period. This particularly applies to the liquid phases of the reservoir.

As an example of this, the formation water in an oil reservoir may have a viscosity of approximately 1 centipoise (cP), and the crude oil thereof may have a viscosity of approximately 10 cP. A volume mixture of 50% formation water and 50% crude oil, however, may have a viscosity of approximately 50 cP or more. Due to viscous oil/water emulsions normally forming when mixing oil and water, such an oil/water mixture often has a significantly higher viscosity than that of the individual liquid constituent of the mixture.

The formation water of the oil reservoir, however, may have a specific gravity of approximately 1.03 kg/dm$^3$, and its crude oil may have a specific gravity in the order of 0.75-1.00 kg/dm$^3$. The mixture of formation water and crude oil therefore will have a specific gravity in the order of 0.75-1.03 kg/dm$^3$.

The Objective of the Invention

The primary objective of the invention is to provide a flow control device that reduces or eliminates the disadvantages and problems of prior art flow control devices. This particularly concerns those disadvantages and problems associated with viscosity fluctuations of the inflowing reservoir fluids during recovery of hydrocarbons from at least one underground reservoir via a horizontal well.

More particularly, the objective is to provide a flow control device that provide for a relatively stable and predictable pressure loss to exist in fluids flowing into the production tubing of a well via the flow control device, and even though the reservoir fluid viscosities vary during the recovery period of the well. Thus the fluid inflow rate through the flow control device also will become relatively stable and predictable during the recovery period.

Achieving the Objective

The objective is achieved through features as disclosed in the following description and in the subsequent patent claims.

Adapted choking of the pressure of at least partial flows of the inflowing reservoir fluids may be carried out by placing at least one flow control device according to the invention along the inflow portion of the production tubing. Thereby reservoir fluids from different reservoir zones may flow into the well with equal, or nearly equal, radial inflow rate per unit length of the inflow portion, and even though the fluid viscosities change during the recovery period. In position of use, at least one position along the inflow portion of the production tubing is provided with a flow control device according to the invention. When using several such flow control devices, each flow control device is placed at a suitable distance from the other flow control devices.

A flow control device according to the invention comprises a flow channel through which the reservoir fluids may flow. The flow channel consists of an annular cavity formed between an external housing and a base pipe and an inlet in the upstream end of the cavity. The external housing is formed as an impermeable wall, for example as a longitudinal sleeve of circular cross section, while the base pipe comprises a main constituent of a tubing length of the production tubing. In its downstream end, the flow channel comprises at least one through-going wall opening in the base pipe. The flow channel thereby connects the inside of the base pipe with the surrounding reservoir rocks. In its upstream end, the flow channel also may be connected to at least one sand screen that connects the flow channel with the reservoir rocks, and that prevent formation particles from flowing into the production tubular. The flow channel has at least one through-going channel opening that is provided with a flow restriction. This flow restriction may be placed in said wall opening in the base pipe. The flow restriction also may be placed in a through-going channel opening in an annular collar section within the external housing, the collar section extending into the cavity between the housing and the base pipe.

The distinctive characteristic of the invention is that each such channel opening is provided with a flow restriction selected from the following types of flow restrictions:

a nozzle;

an orifice in the form of a slit or a hole; or a sealing plug.

During fluid flow through a nozzle or an orifice, pressure energy is converted to velocity energy. A nozzle or an orifice is a constructional element intentionally designed to avoid, or to avoid as much as possible, an energy loss in fluids flowing through it. Hence the element functions as a velocity-increasing element. The fluids exit with great velocity and collide with fluids located downstream of the velocity-increasing element. This continuous colliding of fluids provide for permanent impact loss in the form of heat loss. This energy loss reduces the pressure energy of the flowing fluids, whereby a permanent pressure loss is inflicted on the fluids that reduces their inflow rate into the production tubing. Thus the energy loss arises downstream of the nozzle or the orifice. In the flow control devices according to EP 0.588.421, however, the energy loss exists as flow friction in channels of the devices. The energy loss caused by the present flow control device therefore result from using another rheological principle than the rheological principle exploited in said prior art flow control devices. However, the rheological principle selected for use in a flow control device may greatly influence the individual pressure choking profile of partial reservoir fluid flows entering the production tubing. Thus the rheological principle selected may greatly influence the production profile of a well during its recovery period.

The energy loss arising from fluid flow through nozzles and orifices predominantly is influenced by changes in the specific gravity of the fluids. On the contrary, changes in fluid viscosity have little influence on this energy loss. These conditions may be exploited advantageously in hydrocarbon production, and especially in the production of crude oil and associated liquids. Under such conditions the present flow control device may provide a relatively stable and predictable fluid inflow rate during the recovery period. This technical effect significantly deviates from that of the flow control devices disclosed in EP 0.588.421, the devices of which, when subjected to the noted conditions, provide for an unstable and unpredictable fluid inflow rate during the recovery period. This significant difference in technical effect results from the modes of operation and underlying working principles being different in the known flow control devices as compared to those of the device according to the invention.

The pressure choking of inflowing reservoir fluids within individual flow control devices along the inflow portion of the well must be adapted to the prevailing conditions at the particular inflow position of the reservoir. For example, such conditions include the recovery rate of the well, fluid pressures and fluid compositions within and along the production tubing and in the reservoir rocks external thereto, the relative positions of individual flow control devices with respect to one another along the production tubing, and also the reservoir rock strength, porosity and permeability at the particular inflow position.

The energy loss arising from fluid collision, and occurring downstream of the flow restriction (i.e. the nozzle or the orifice), may be measured as a difference in the dynamic pressure of the fluid within the flow restriction itself (position 1) and at a flow position (position 2) immediately downstream of the fluid collision zone.

Derived from Bernoulli's equation, the dynamic pressure 'p' of the fluid may be expressed as:

$$p=\tfrac{1}{2}(\rho\cdot v^2);\text{ in which}$$

'ρ' is the specific gravity of the fluid; and

'v' is the flow velocity of the fluid.

Said energy loss thus may be expressed as the difference between the dynamic pressure at upstream position 1 and at downstream position 2. The fluid pressure loss '$\Delta p_{1-2}$' thus may be expressed in the following way:

$$\Delta p_{1-2}=\tfrac{1}{2}\rho\cdot(v_1^2-v_2^2);\text{ in which}$$

'ρ' is the specific gravity of the fluid;

'$v_1$' is the flow velocity of the fluid at position 1;

and

'$v_2$' is the flow velocity of the fluid at position 2.

From this follows that the dynamic pressure loss '$\Delta p_{1-2}$' of the fluid is influenced by changes in the specific gravity of the fluid and/or by changes in the flow velocity of the fluid.

As mentioned, the specific gravity values of the reservoir fluids normally will change but little during the recovery period and therefore will have little influence on the fluid energy loss caused by the present flow control device. Consequently, the pressure loss '$\Delta p_{1-2}$' predominantly is influenced by changes in fluid velocity when flowing through said flow restriction. By selecting a suitable cross sectional area of flow for the nozzle or orifice, however, the fluid flow velocity through the flow restriction may be controlled. This cross sectional area of flow also may be distributed over several such restrictions in the flow control device. The total cross sectional area of flow within the device may be equally or unequally distributed between the flow restrictions of the device.

When using several flow control devices along the inflow portion of the production tubing, each device may be arranged with a cross sectional area of flow adapted to the individual device to cause the desired energy loss, hence the desired inflow rate, in the partial fluid flow that flows through the flow control device. Thereby the differential pressure driving the fluids from the surrounding reservoir rock and into the production tubing, also may be suitably adapted and reduced.

This is particularly useful when used in horizontal wells, wherein said differential pressure normally increases strongly in the downstream direction of the inflow portion of the production tubing, and wherein the need for choking the reservoir fluid pressure, hence controlling the inflow rate, increases strongly in the downstream direction of the inflow portion. Under such conditions, downstream portions of the production tubing therefore may be provided with a suitable number of flow control devices according to the invention, inasmuch as each device, when in position of use, is placed in a suitable position along the inflow portion to effect adapted pressure choking of the fluids flowing through it. On the contrary, in upstream portions of the production tubing the reservoir fluids may flow directly into the production tubing through openings or perforations therein, and potentially via one or more upstream sand screens.

Moreover, singular or groupings of flow control devices may be associated with different production zones of the reservoir or reservoirs through which the well penetrates. For purposes of production, the different production zones may be separated by means of pressure- and flow isolating packers known in the art.

Prior to completing or re-completing a well, further information often is gathered regarding reservoir rock production properties and reservoir fluid compositions, pressures, temperatures and alike. Furthermore, at hand is already information concerning desired recovery rate and recovery method(s), reservoir heterogeneity, length of the well inflow portion, estimated flow pressure loss within the production tubing etc. Based on this information, a probable flow- and pressure profile for the inflowing reservoir fluids may be estimated, both in terms of their physical attributes and in terms of changes in these over time. Thus the concrete need for flow control devices in a particular well may be estimated and decided upon, this including deciding the number, relative positioning and density, and also individual design of the flow control devices. Such decisions and individual adjustments often must be made within a very short timeframe. This, however, requires a simple, efficient and flexible way of arranging the inflow portion of the production tubing with a suitable pressure choking profile. Preferably, this work of adjustment should be carried out immediately before the production tubing is installed in the well. The work of adjustment presupposes that each flow control device of the production tubing quickly and easily may be arranged to cause a degree of pressure choking that is adapted to a specific recovery rate and also to the conditions prevailing at the device's intended position in the well.

By forming the at least one flow restriction into a removable and replaceable insert, this problem may be solved. The insert, in the form of a nozzle, an orifice or a sealing plug, is placed in mating formation in said through-going opening in the flow channel of the device, the opening hereinafter referred to as an insert opening. The insert and the accompanying insert opening are of complementary shape. An insert opening may consist of a bore or perforation through said base pipe or through said annular collar section in the flow channel of the device. For example, the insert also may be externally circular. The collar section may consist of a circular steel sleeve or steel collar provided within the external housing of the device. By means of fastening devices and methods known in the art, such as threaded connections, ring fasteners, including Seeger-rings, fixing plates, retaining sleeves or retaining screws, the insert may be removably secured within the associated insert opening.

A flow channel that comprises more than one insert opening also may be provided with inserts containing different types of flow restrictions of said types. Thus the flow channel may be provided with any combination of nozzles, orifices and sealing plugs. Moreover, nozzles and/or orifices in the flow channel may be different internal cross sectional area of flow. Thus, nozzles in the flow channel may have different internal nozzle diameters. Furthermore, sealing plugs may be used to plug insert openings through which no fluid flow is desired. Each flow control device of the production tubing thereby may be arranged with a degree of pressure choking adapted to the individual device, the reservoir fluids thus obtaining equal, or nearly equal, radial inflow rate per unit length of the inflow portion of the well.

A flow control device having nozzle inserts placed in through-going openings in the wall of the production tubing also may be provided with one or more pairs of nozzles. Preferably, the two nozzle inserts in a pair of nozzles should be placed diametrically opposite each other in the pipe wall. When fluids flow through the nozzle inserts of such a pair of nozzles, the exiting fluid jets are led towards each other and collide internally in the production tubing. Thus the fluid jet hit the internal surface of the production tubing with attenuated impact velocity and force, thereby reducing or avoiding erosion of the pipe wall.

When using several removable and replaceable inserts in a flow control device, the inserts should be of identical external size and shape, as should their corresponding insert openings, for example inserts and insert bores of identical diameters. Moreover, when using several flow control devices in a production tubing, all inserts and insert openings should be of identical external size and shape.

Furthermore, the insert openings in such a flow control device should be easily accessible, thus providing for easy placement or replacement of inserts in the insert openings. According to the invention, this accessibility may be achieved by arranging the external housing of the flow control device in a manner allowing temporary access to the insert openings. For example, the external housing may be provided with at least one through-going access opening, for example a bore, being placed immediately external to a corresponding insert opening in the base pipe wall. For this purpose a removable covering sleeve or covering plate that covers the at least one access opening, and that quickly and easily may be removed from the housing, may enclose the housing. Thereby the at least one access opening may be uncovered easily to obtain access to the corresponding insert opening(s). When the at least one insert opening is placed in said annular collar section within said external housing, the housing may comprise an annular housing removably enclosing the collar section. Removing the annular housing from the collar section allows for temporary access to the at least one insert opening in the collar section, whereby insert(s) quickly and easily may be placed or replaced in the insert opening(s) of the collar section.

By using such removable and replaceable inserts, the production tubing of the well may be optimally adapted to the most recent well- and reservoir information provided immediately before running the tubing into the well. In this connection, one or more insert openings of a flow control device may, among other things, be provided with a sealing plug that stops fluid through-flow. This relates to the fact that prior to running the production tubing into the well, and before said well- and reservoir information becomes available, it may be difficult to determine the exact number, relative position and individual design of the flow control devices thereof. Therefore it may be expedient and time saving to arrange a certain number of individual pipe lengths of the production tubing with flow control devices of a standard design, and with a standard number of empty insert openings. Having gained access to updated well- and reservoir information, each flow control device of the production tubing may be provided with a degree of pressure choking adapted to the individual device. Each device is provided with a flow restriction that is selected from the above-mentioned types of restrictions, and that is selected in the desired number, size and/or combination. If, for example, the fluid inflow is to be stopped through such a standardised flow control device, all insert openings therein may be provided with sealing plugs.

BRIEF DESCRIPTION OF THE DRAWINGS

In the following, two non-limiting embodiments of the flow control device according to the invention are disclosed, referring also to the accompanying drawings thereof. One specific reference numeral refers to the same detail in all drawings in which the detail is shown, in which:

FIG. 1 and FIG. 3, wherein the section shows a connecting sleeve mounted between the flow control device and a sand screen, and FIG. 5 also shows section line I-I through the pipe length; and where FIG. 1 and FIG. 3, wherein the part section shows details of said sand screen, and FIG. 6 also shows section line I-I through the pipe length.

DESCRIPTION OF TWO EMBODIMENTS OF THE INVENTION

Figure 1:
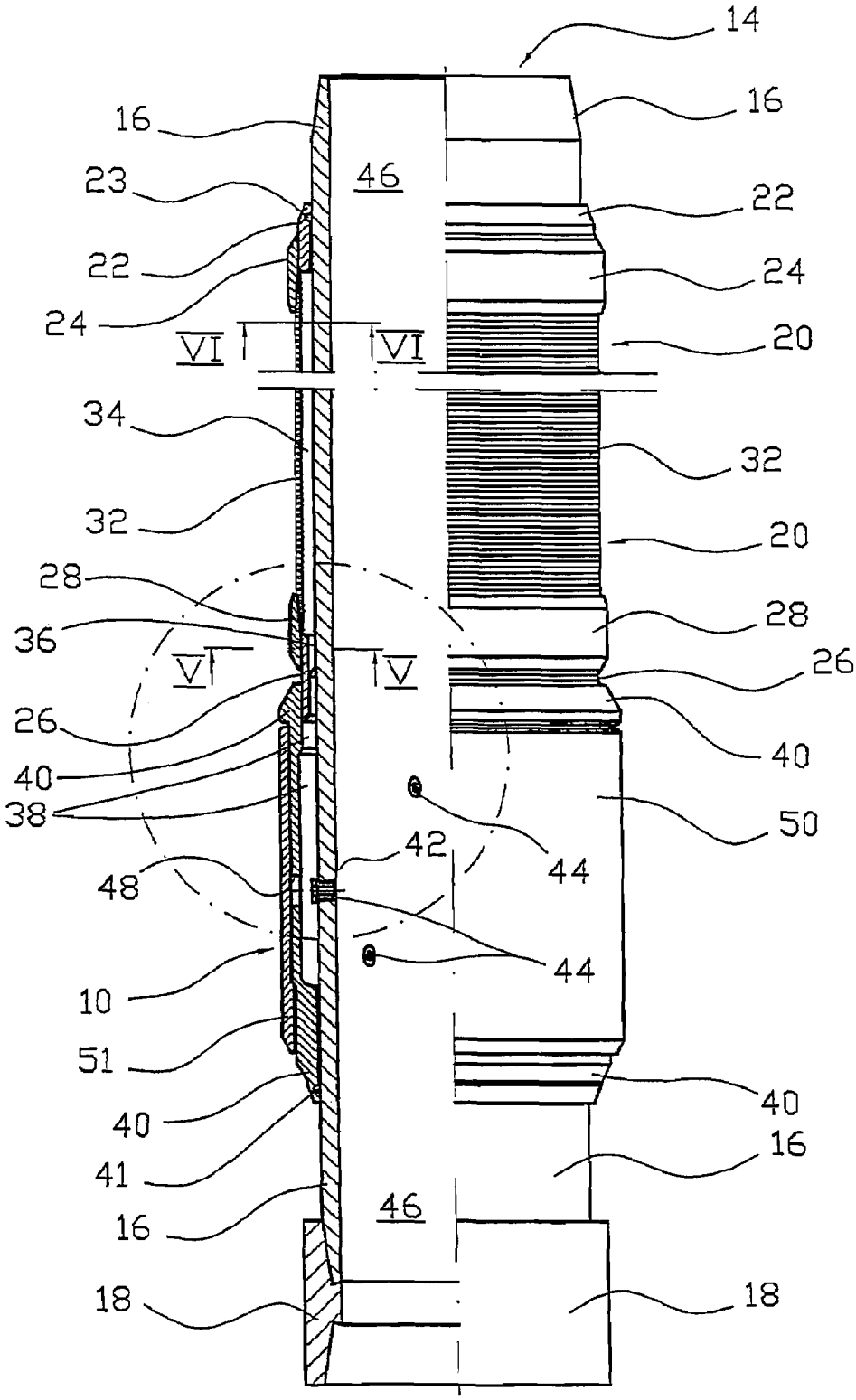
FIG. 1 shows a part section through a pipe length of a production tubing, wherein the pipe length is provided with a flow control device according to the invention, and wherein the device comprises, among other things, nozzle inserts placed in radial insert bores in the wall of the pipe length, and FIG. 1 also shows section lines V-V and VI-VI through the pipe length.
Figure 2:
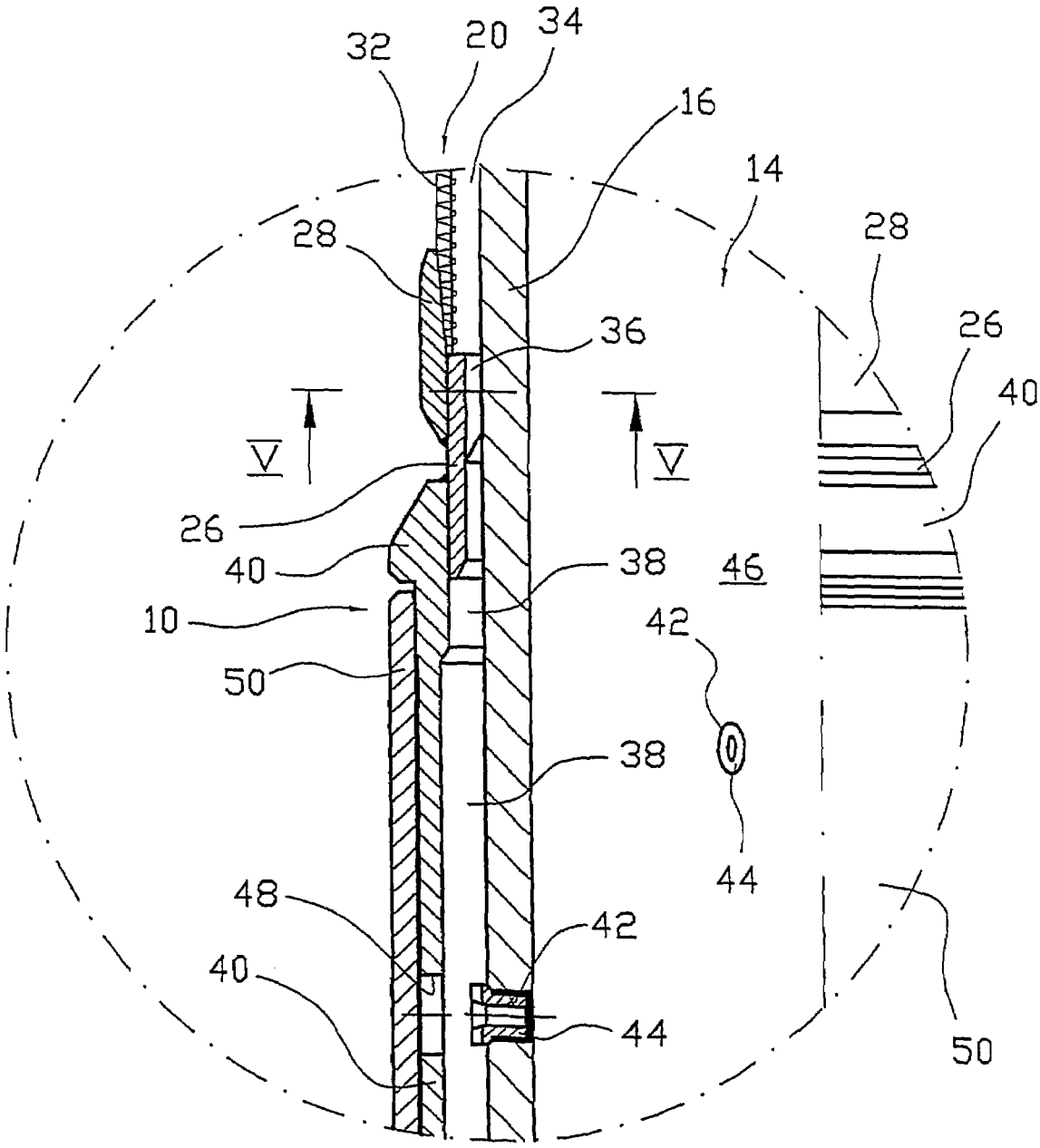
FIG. 2 is an enlarged section of details of the flow control device shown in FIG. 1, and FIG. 2 also shows section line V-V through the pipe length.
Figure 3:
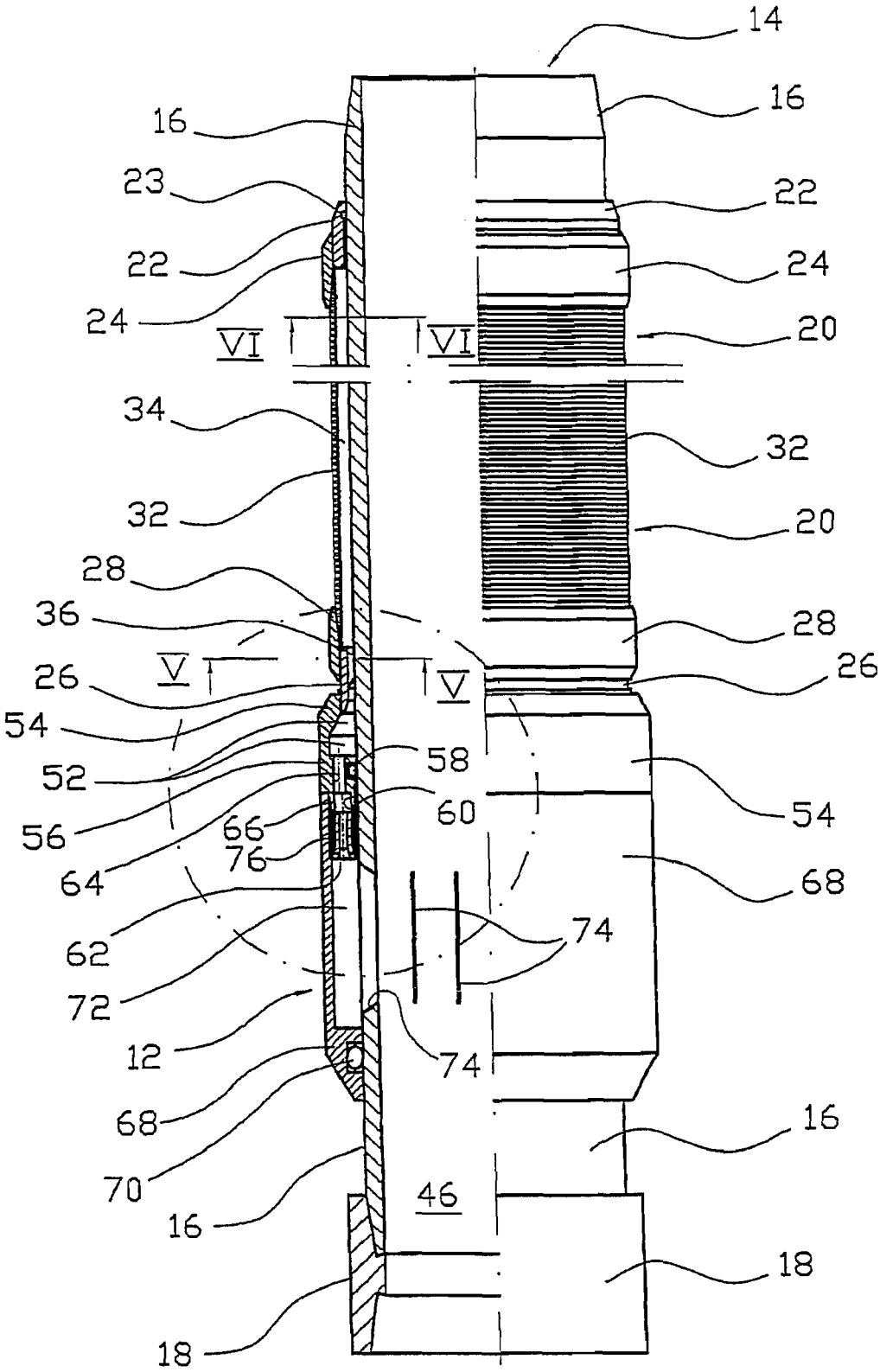
FIG. 3 shows a part section through a pipe length that is provided with another flow control device according to the invention, but wherein this device comprises nozzle inserts placed in axial insert bores in an annular housing surrounding the pipe length, and FIG. 3 also shows section lines V-V and VI-VI through the pipe length.
Figure 4:
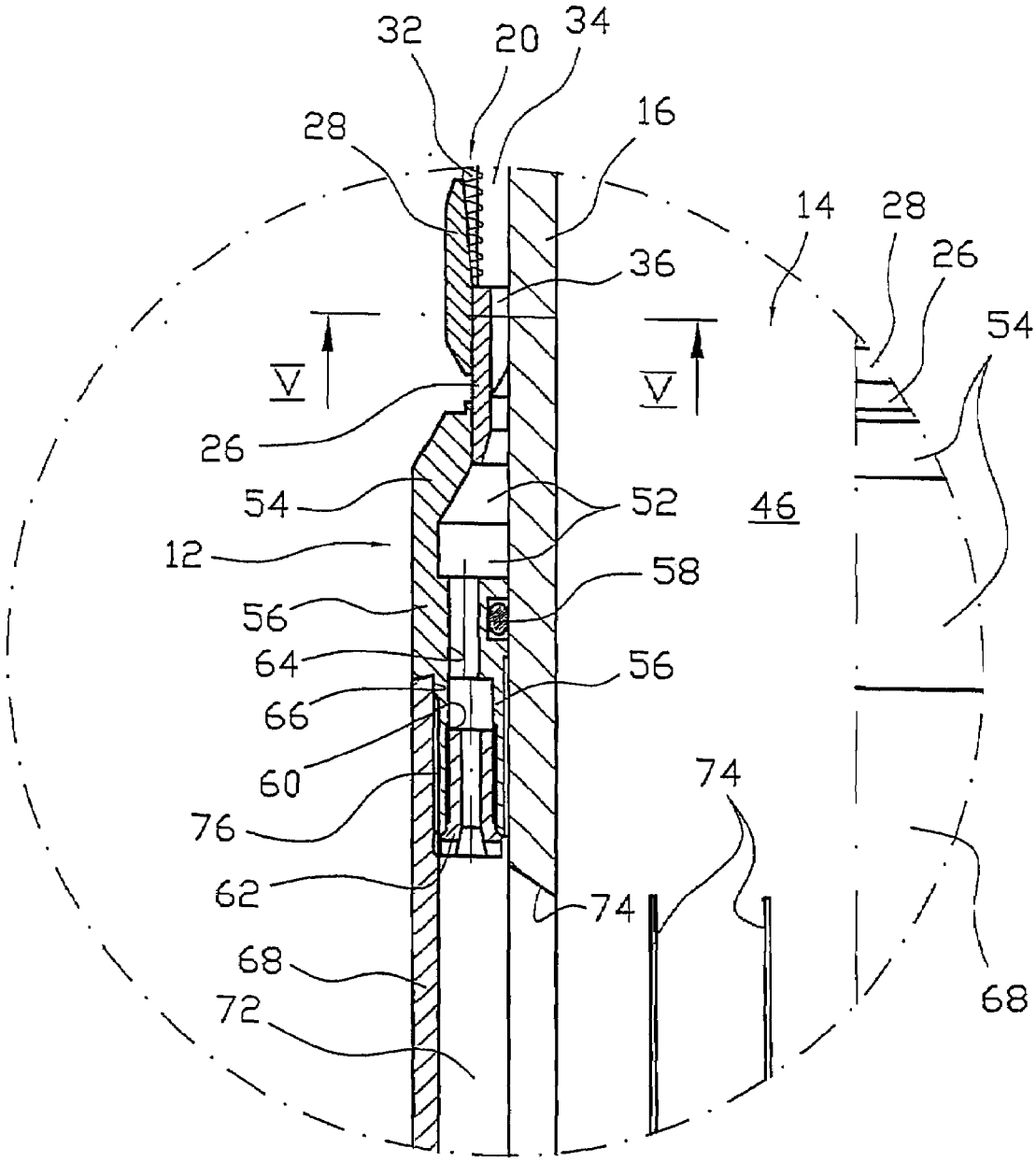
FIG. 4 shows an enlarged circular section of details of the flow control device according to FIG. 1, and FIG. 4 also shows section line V-V through the pipe length.
Figure 5:
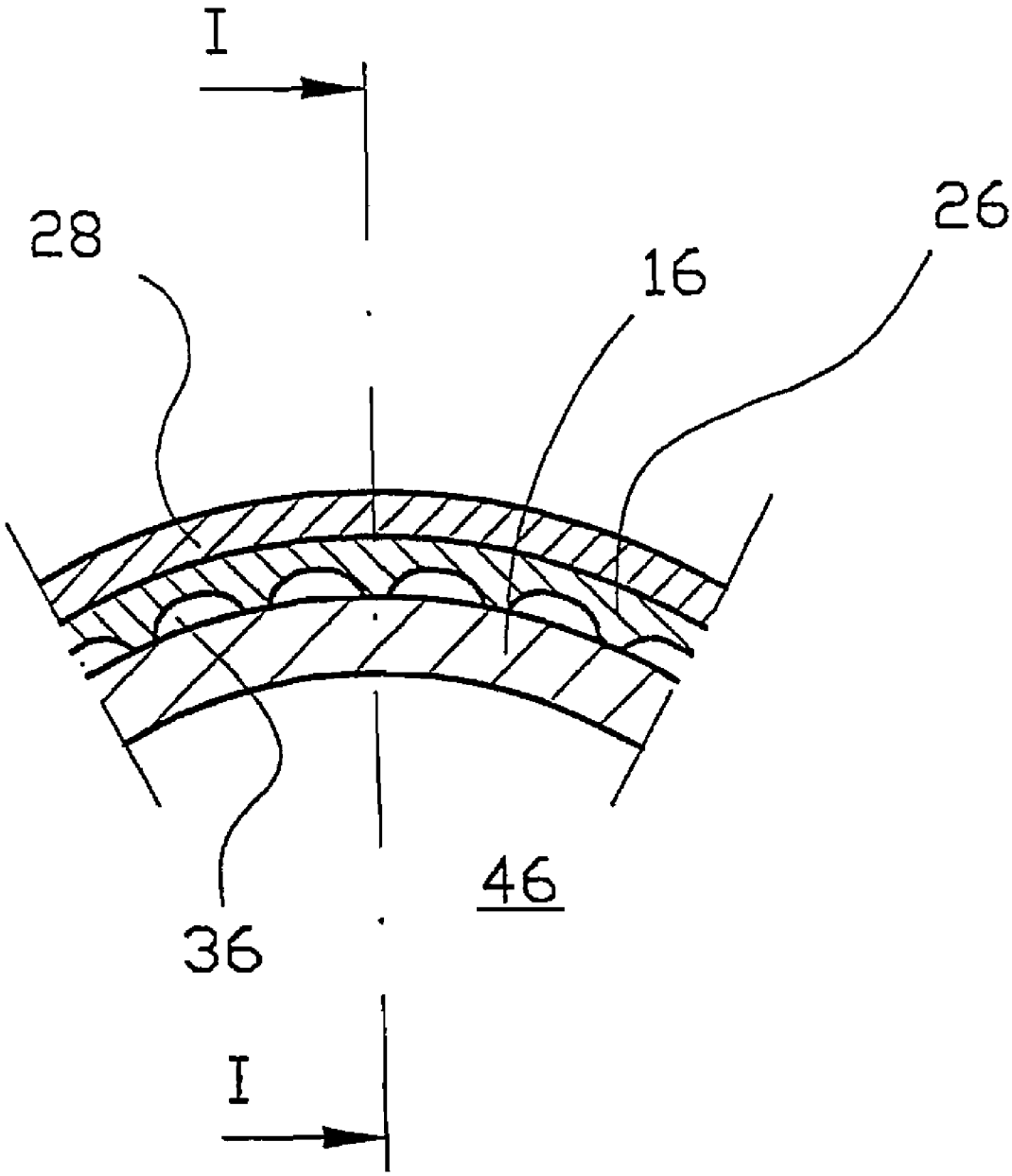
FIG. 5 shows a radial part section along section line V-V, cf.
Figure 6:
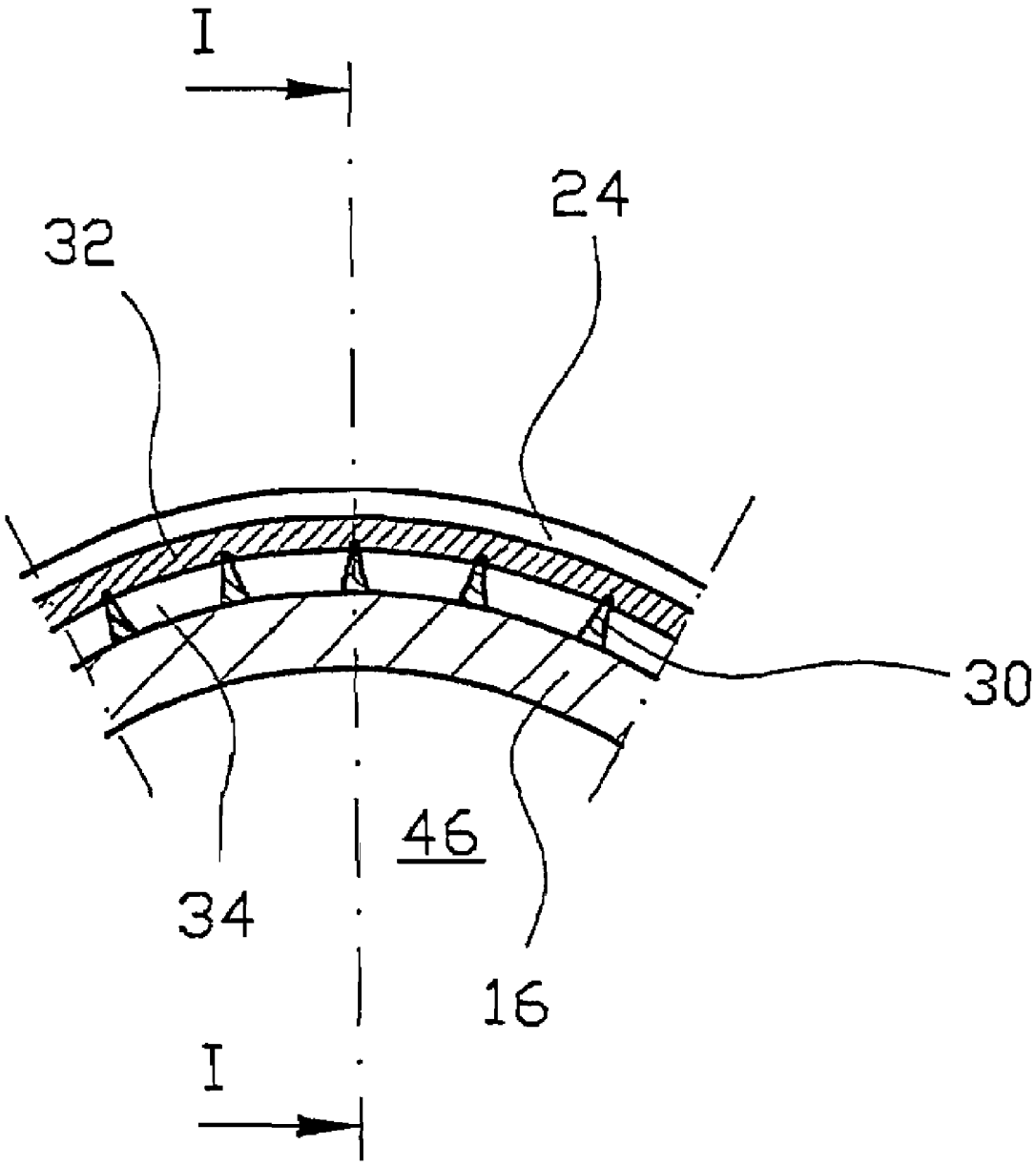
FIG. 6 shows a part section along section line VI-VI, cf.

FIG. 1 and FIG. 2 show a first flow control device 10 according to the invention, while FIG. 3 and FIG. 4 show a second flow control device 12 according to the invention. FIG. 5 and FIG. 6 show structural features common to both embodiments.

Moreover, both flow control device 10, 12 are provided to a pipe length 14 connected to other such pipe lengths 14 (not shown), which together comprise a production tubing of a well. The pipe length 14 consists of a base pipe 16, each end thereof being threaded, thus allowing the pipe length 14 to be coupled to other such pipe lengths 14 via threaded pipe couplings 18. In these embodiments the base pipe 16 is provided with a sand screen 20 located upstream thereof. One end portion of the sand screen 20 is connected to the base pipe 16 by means of an inner end sleeve 22 fitted with an internal ring gasket 23 and an enclosing an outer end sleeve 24. By the flow control device 10, 12, the other end portion of the sand screen 20 and a connecting sleeve 26 are firmly connected by means of an outer end sleeve 28. The sand screen 20 is provided with several spacer strips 30 secured to the outer periphery of the base pipe 16 at a mutually equidistant angular distance and running in the axial direction of the base pipe 16, cf. FIG. 6. Continuous and closely spaced wire windings 32 are wound onto the outside of the spacer strips 30 in a manner providing a small slot opening between each wire winding 32, through which slot openings the reservoir fluids may flow from the surrounding reservoir rocks. Thus several axial flow channels 34 exist along the outside of the pipe 16, these existing between successive and adjacent spacer strips 30 and also between the wire windings 32 and the pipe 16. Through these channels 34 reservoir fluids may flow onto and through the connecting sleeve 26. The connecting sleeve 26 also is formed with axial, but semi-circular, flow channels 36 that are equidistantly distributed along the circumference of the connecting sleeve 26, cf. FIG. 5. Through these channels 36 the fluids may flow onwards into the flow control device 10, 12. It should be noted, however, that each individual axial flow channel 34, 36 is formed with a relatively large cross sectional area of flow. During fluid flow through the channels 34, 36, the flow friction and the associated fluid pressure loss thus will be minimised relative to the energy loss caused by the flow restrictions in the flow control device 10, 12 located downstream thereof.

Figure 7:
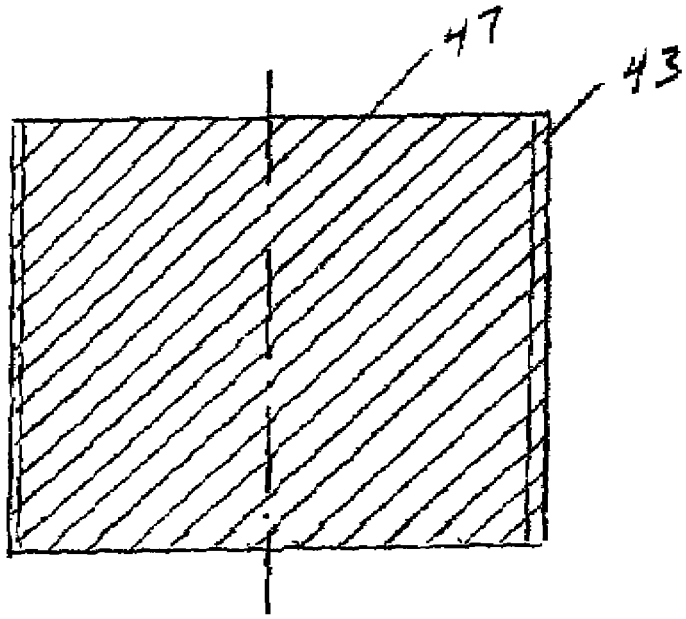
FIG. 7 shows an insert that is a sealing plug.

In the first embodiment of the invention, cf. FIG. 1 and FIG. 2, reservoir fluids are flowing into an annulus 38 in the flow control device 10. The annulus 38 consists of the cavity existing between the base pipe 16 and an enclosing and tubular housing 40 having circular cross section. The upstream end portion of the housing 40 encloses the connecting sleeve 26, while the downstream end portion of the housing 40 encloses the pipe 16. In this embodiment the downstream end portion of the housing 40 is fitted with an internal ring gasket 41. A portion of the pipe 16 being in direct contact with the annulus 38, is provided with several through-going and threaded insert bores 42 of identical bore diameter. A corresponding number of externally threaded and pervasively open nozzle inserts 44 are removably placed in the insert bores 42. The nozzle inserts 44 may be of one specific internal nozzle diameter, or they may be of different internal nozzle diameters. All fluids flowing in through the sand screen 20 are led up to and through the nozzle inserts 44, after which they experience an energy loss and an associated pressure loss. The fluids then flow into the base pipe 16 and onwards in the internal bore 46 thereof. If no fluid flow is desired through one or more insert bores 42 in the flow control device 10, this/these insert bore(s) 42 may be provided with a threaded sealing plug insert 47 (*Fig.7c*). In order to allow for fast placement or replacement of nozzle inserts 44 and/or sealing plug inserts in said insert bores 42, the housing 40 is provided with through-going access bores 48 that correspond in number and position to the insert bores 42 placed inside thereof. Nozzle inserts 44 and/or sealing plug inserts may be placed or replaced through these access bores 48 using a suitable tool. In this embodiment the access bores 48 are shown sealed from the external environment by means of a covering sleeve 50 removably, and preferably pressure-sealingly, placed at the outside of the tubular housing 40 and using a threaded connection 51. The pipe length 14 then may be connected to other pipes 14 to comprise continuous production tubing.

In the second embodiment of the invention, cf. FIG. 3 and FIG. 4, reservoir fluids are flowing from said connecting sleeve 26 and onwards in a downstream direction into a first annulus 52 of the flow control device 12. The annulus 52 consists of the cavity existing between the base pipe 16 and an enclosing and tubular housing 54 having circular cross section, the annulus 52 forming an integral part of the housing 54. The upstream end portion of the housing 54 encloses the connecting sleeve 26, while the downstream end portion of the housing 54 is provided with an annular collar section 56 enclosing the pipe 16, and extending into said cavity. In this embodiment the collar section 56 is fitted with an internal ring gasket 58. Moreover, the collar section 56 is provided with several axially through-going and threaded insert bores 60 distributed along the circumference thereof, the bores 60 having identical bore diameters. A corresponding number of threaded and pervasively open nozzle inserts 62 are removably placed in the insert bores 60. Resembling the flow control device 10, nozzle inserts 62 having different internal nozzle diameters may be placed in the in the insert bores 60. One or more insert bores 60 also may be provided a threaded sealing plug insert (not shown). Internally the collar section 56 is provided with extension bores 64 connecting the insert bores 60 and the annulus 52. Immediately outside of the insert bores 60 the collar section 56 also is formed with an outer peripheral section 66 that is recessed relative to the remaining part of the peripheral surface of the collar section 56. An upstream end portion of an annular housing 68 is removably, and preferably pressure-sealingly, placed around said peripheral section 66, while a downstream end portion of the annular housing 68 encloses the pipe 16. In this embodiment the downstream end portion of the annular housing 68 is fitted with an internal ring gasket 70.

Thus a second annulus 72 exists between the pipe 16 and the annular housing 68. Reservoir fluids thereby flow through the nozzle inserts 62 and into the second annulus 72, then through several axial slit openings 74 in the pipe 16, and then they flow onwards in the internal bore 46 of the base pipe 16. Also in this embodiment the reservoir fluids experience an energy loss and an associated pressure loss downstream of the nozzle inserts 62. Furthermore, by means of a threaded connection 76, the annular housing 68 may be detached and temporarily removed from the peripheral section 66. Thereby the annular housing 68 may be removed to obtain access to the insert bores 60 in the collar section 56, hence allowing for expedient placement or removal of nozzle inserts 62 and/or sealing plug inserts.

The invention claimed is:

1. An arrangement for regulating inflow of fluids from an underground reservoir to a well, the arrangement comprising:

an elongated base pipe;

an impermeable section of housing that encircles the base pipe;

wherein the base pipe and section of housing together define a cavity through which reservoir fluids can flow;

an inlet proximate a first end of the cavity and configured to receive inflow of reservoir fluids;

at least one through-going wall opening in the base pipe proximate a second end of the cavity;

wherein the cavity, inlet and at least one through-going wall opening together define a flow path along which reservoir fluids flow from the underground reservoir to inside of the base pipe;

a first removable and replaceable insert disposed in the flow path and configured to restrict flow into the base pipe, the first insert being shaped in the form of a type of flow restriction consisting of a nozzle; and a second removable and replaceable insert disposed in the flow path and configured to restrict flow into the base pipe, the second insert being shaped in the form of a type of flow restriction consisting of an orifice in the shape of a slit or hole.

2. The arrangement of claim 1, further comprising a third removable and replaceable insert disposed in the flow path and configured to restrict flow into the base pipe, the third insert being shaped in the form of a sealing plug.

3. The arrangement of claim 2, wherein the first, second and third inserts are disposed at different fixed positions in the flow path.

4. The arrangement of claim 3, wherein the first, second and third inserts have a substantially identical outer shape to facilitate interchanging the respective inserts into and out of a same fixed position along the flow path.

5. The arrangement of claim 4, wherein the total flow cross-section for the flow path is equally or unequally distributed amongst the first and second inserts.

6. The arrangement of claim 1, comprising a sand screen coupled to an upstream end of the flow path, the sand screen connecting the flow path to the underground reservoir.

7. The arrangement of claim 1, wherein the reservoir fluid flows through the first and second inserts in a longitudinal direction that is substantially parallel to the elongated base pipe.

8. An arrangement for regulating inflow of fluids from an underground reservoir to a well, the arrangement comprising:

an elongated base pipe;

an impermeable section of housing that encircles the base pipe;

wherein the base pipe and section of housing together define a cavity through which reservoir fluids can flow;

an inlet proximate a first end of the cavity and configured to receive inflow of reservoir fluids;

at least one through-going wall opening in the base pipe proximate a second end of the cavity;

wherein the cavity, inlet and at least one through-going wall opening together define a flow path along which reservoir fluids flow from the underground reservoir to inside of the base pipe; and a plurality of removable and replaceable inserts disposed in the flow path and configured to restrict flow into the base pipe, each insert in the plurality being shaped in the form of a type of flow restriction selected from the group consisting of a nozzle, an orifice in the shape of a slit or a hole, and a plug;

wherein the plurality of inserts comprises at least two different types of said flow restrictions; and wherein the housing comprises through-going access bore positioned immediately outside a corresponding wall opening.

9. The arrangement of claim 8, comprising a detachable covering sleeve that covers the access bore.

10. An arrangement for regulating inflow of fluids from an underground reservoir to a well, the arrangement comprising:

an elongated base pipe;

an impermeable section of housing that encircles the base pipe;

wherein the base pipe and section of housing together define a cavity through which reservoir fluids can flow;

an inlet proximate a first end of the cavity and configured to receive inflow of reservoir fluids;

at least one through-going wall opening in the base pipe proximate a second end of the cavity;

wherein the cavity, inlet and at least one through-going wall opening together define a flow path along which reservoir fluids flow from the underground reservoir to inside of the base pipe; and a plurality of removable and replaceable inserts disposed in the flow path and configured to restrict flow into the base pipe, each insert in the plurality being shaped in the form of a type of flow restriction selected from the group consisting of a nozzle, an orifice in the shape of a slit or a hole, and a plug;

wherein the plurality of inserts comprises at least two different types of said flow restrictions; and comprising a collar section residing in the cavity and defining a through-going channel opening, wherein a first insert from the plurality of inserts is disposed in a fixed position in the through-going channel opening.

11. The arrangement of claim 10, wherein the first insert is formed in the shape of a nozzle.

12. The arrangement of claim 11, wherein a second insert from the plurality of inserts is formed in the shape of a plug and is configured to be disposed in the fixed position in the through-going channel opening in interchangeable relation with the first insert.

13. The arrangement of claim 11, wherein a second insert from the plurality of inserts is formed in the shape of an orifice in the shape of a slit or hole and is configured to be disposed in the fixed position in the through-going opening in interchangeable relation with the first insert.

14. An arrangement for regulating inflow of fluids from an underground reservoir to a well, the arrangement comprising:

an elongated base pipe;

an impermeable section of housing that encircles the base pipe;

wherein the base pipe and section of housing together define a cavity through which reservoir fluids can flow;

an inlet proximate a first end of the cavity and configured to receive inflow of reservoir fluids;

at least one through-going wall opening in the base pipe proximate a second end of the cavity;

wherein the cavity, inlet and at least one through-going wall opening together define a flow path along which reservoir fluids flow from the underground reservoir to inside of the base pipe; and a first removable and replaceable insert disposed in a fixed position in the flow path, the first insert having an aperture that has a fixed flow cross-section sized to receive reservoir fluids and to permit pressure reduction and thereby control of reservoir fluid flow by fluid collision between reservoir fluid that has passed through the first insert and fluid downstream of the first insert; and a second removable and replaceable insert disposed in a fixed position in the flow path, the second insert being shaped in the form of a sealing plug;

wherein the first and second inserts have a complementary size and shape so that the respective fixed positions of the first and second inserts can be switched, whereby the first insert can be fixed in the position of the second insert and the second insert can be fixed in the position of the first insert.

15. The arrangement of claim 14, wherein the aperture of the first insert has the shape of one of a nozzle and an orifice in the shape of a slit or a hole.

16. The arrangement of claim 15, comprising a third removable and replaceable insert disposed in a fixed position in the flow path, the third insert having the other shape of the nozzle and the orifice in the shape of a slit or a hole.

17. An arrangement for regulating inflow of fluids from an underground reservoir to a well, the arrangement comprising:

an elongated base pipe;

an impermeable section of housing that encircles the base pipe;

wherein the base pipe and section of housing together define a cavity through which reservoir fluids can flow;

an inlet proximate a first end of the cavity and configured to receive inflow of reservoir fluids;

at least one through-going wall opening in the base pipe proximate a second end of the cavity;

wherein the cavity, inlet and at least one through-going wall opening together define a flow path along which reservoir fluids flow from the underground reservoir to inside of the base pipe; and a first removable and replaceable insert disposed in a fixed position in the flow path, the first insert having an aperture that has a fixed flow cross-section sized to receive reservoir fluids and to permit pressure reduction and thereby control of reservoir fluid flow by fluid collision between reservoir fluid that has passed through the first insert and fluid downstream of the first insert; and a second removable and replaceable insert disposed in a fixed position in the flow path, the second insert being shaped in the form of a sealing plug;

wherein the first and second inserts have a complementary size and shape so that the respective fixed positions of the first and second inserts can be switched, whereby the first insert can be fixed in the position of the second insert and the second insert can be fixed in the position of the first insert; and comprising a collar section disposed in the cavity, wherein the first and second inserts are configured to interchangeably fit into and reside in a same through-going channel opening in the collar section.

18. An arrangement for regulating inflow of fluids from an underground reservoir to a well, the arrangement comprising:

an elongated base pipe;

an impermeable section of housing that encircles the base pipe;

wherein the base pipe and the section of housing together define a cavity through which reservoir fluids can flow;

an inlet proximate a first end of the cavity and configured to receive inflow of reservoir fluids;

at least one through-going wall opening in the base pipe proximate a second end of the cavity;

wherein the cavity, inlet and at least one through-going wall opening together define a flow path along which reservoir fluids flow from the underground reservoir to the inside of the base pipe;

a first removable and replaceable insert disposed in the flow path and configured to restrict flow into the pipe, the first insert being shaped in the form of a type of flow restriction consisting of a nozzle; and a second removable and replaceable insert disposed in the flow path and configured to restrict flow into the base pipe, the second insert being shaped in the form of a sealing plug.

* * * * *